US007295084B2

(12) United States Patent
Tanbakuchi et al.

(10) Patent No.: US 7,295,084 B2
(45) Date of Patent: Nov. 13, 2007

(54) ELECTRICAL INTERCONNECTION FOR COAXIAL LINE TO SLAB LINE STRUCTURE INCLUDING A BEAD RING

(75) Inventors: Hassan Tanbakuchi, Santa Rosa, CA (US); Matthew R. Richter, Santa Rosa, CA (US); Michael B. Whitener, Santa Rosa, CA (US); Bobby Y. Wong, Stockton, CA (US); Jim Clatterbaugh, Santa Rosa, CA (US)

(73) Assignee: Agilent Technologies, Inc., Santa Clara, CA (US)

( * ) Notice: Subject to any disclaimer, the term of this patent is extended or adjusted under 35 U.S.C. 154(b) by 97 days.

(21) Appl. No.: 11/238,883

(22) Filed: Sep. 28, 2005

(65) Prior Publication Data

US 2007/0069832 A1 Mar. 29, 2007

(51) Int. Cl.
*H01P 5/02* (2006.01)

(52) U.S. Cl. ..... 333/33; 333/34; 333/260

(58) Field of Classification Search ..... 333/33, 333/34, 245, 260; 439/578
See application file for complete search history.

(56) References Cited

U.S. PATENT DOCUMENTS

| | | | | |
|---|---|---|---|---|
| 5,175,611 | A | 12/1992 | Richardson et al. | |
| 5,307,237 | A | 4/1994 | Walz | |
| 5,508,666 | A * | 4/1996 | Nguyen | 333/33 |
| 5,570,068 | A * | 10/1996 | Quan | 333/33 |
| 5,633,615 | A * | 5/1997 | Quan | 333/33 |
| 5,696,474 | A | 12/1997 | Spivey et al. | |
| 5,936,492 | A | 8/1999 | Shingyoji et al. | |
| 6,241,143 | B1 | 6/2001 | Kuroda | |
| 6,294,966 | B1 | 9/2001 | Huang et al. | |
| 6,331,806 | B1 | 12/2001 | Shingyoji et al. | |
| 6,441,697 | B1 | 8/2002 | Garland et al. | |

* cited by examiner

*Primary Examiner*—Benny Lee

(57) ABSTRACT

An interconnection includes a microcircuit package having a slot, and a receiving feature. A bead ring is fitted into the receiving feature. A center conductor extends through a dielectric support disposed in the bead ring and through the slot. The center conductor forms a coaxial transmission structure in cooperation with the bead ring and the dielectric support, and forms a slab line transmission structure in cooperation with the slot.

11 Claims, 3 Drawing Sheets

ELECTRICAL INTERCONNECTION FOR COAXIAL LINE TO SLAB LINE STRUCTURE INCLUDING A BEAD RING

CROSS-REFERENCE TO RELATED APPLICATIONS

Not applicable.

STATEMENT REGARDING FEDERALLY SPONSORED RESEARCH OR DEVELOPMENT

Not applicable.

REFERENCE TO MICROFICHE APPENDIX

Not applicable.

BACKGROUND OF THE INVENTION

Microcircuits used in microwave and millimeter-wave applications ("high-frequency microcircuits") typically have a number of various devices and circuits ("electrical components") combined in a common metal housing. Transmission structures between the electrical components are very important because they can affect the performance of the high-frequency microcircuit. It is generally desirable that these transmission structures have low loss in order to maximize the power transferred from one electrical component to another, and that parasitic impedance and capacitance is minimized in order to maintain constant electrical impedance. It is also generally desirable to minimize unwanted electrical coupling from one electrical component to another by maximizing the electrical isolation between electrical components. That is, it is desirable to avoid transmission paths between devices other than the intended interconnect path.

A wide variety of transmission lines are used in and between conventional high-frequency microcircuits, including parallel wire, twisted wire, coaxial, slab line, microstrip, coplanar waveguide and waveguide transmission lines. The electronic components of a high-frequency microcircuit are often arranged in a machined metal housing that provides environmental protection and electromagnetic shielding. The metal housing is also often machined to avoid electromagnetic radiation from one component to another; however, the use of simple interconnects, such as wire, ribbon, or mesh bonds, between electrical components in a high-frequency microcircuit often results in higher-order electromagnetic modes that affect isolation between components.

Coplanar waveguide ("CPW") or microstrip interconnects are also used in high-frequency microcircuits; however, a portion of the electromagnetic field in such structures is concentrated in the dielectric material of the structure, which results in loss. Furthermore, CPW and microstrip interconnects are also susceptible of undesirable coupling of power through higher-order modes, thus reducing isolation between electronic components.

Thus, electrical interconnects for use in high-frequency microcircuits that provide low loss and high isolation are desirable.

SUMMARY OF THE INVENTION

An interconnection includes a microcircuit package having a slot, and a receiving feature. A bead ring is fitted into the receiving feature. A center conductor extends through a dielectric support disposed in the bead ring and through the slot. The center conductor forms a coaxial transmission structure in cooperation with the bead ring and the dielectric support, and forms a slab line transmission structure in cooperation with the slot.

DETAILED DESCRIPTION OF THE EMBODIMENTS

Figure 1:
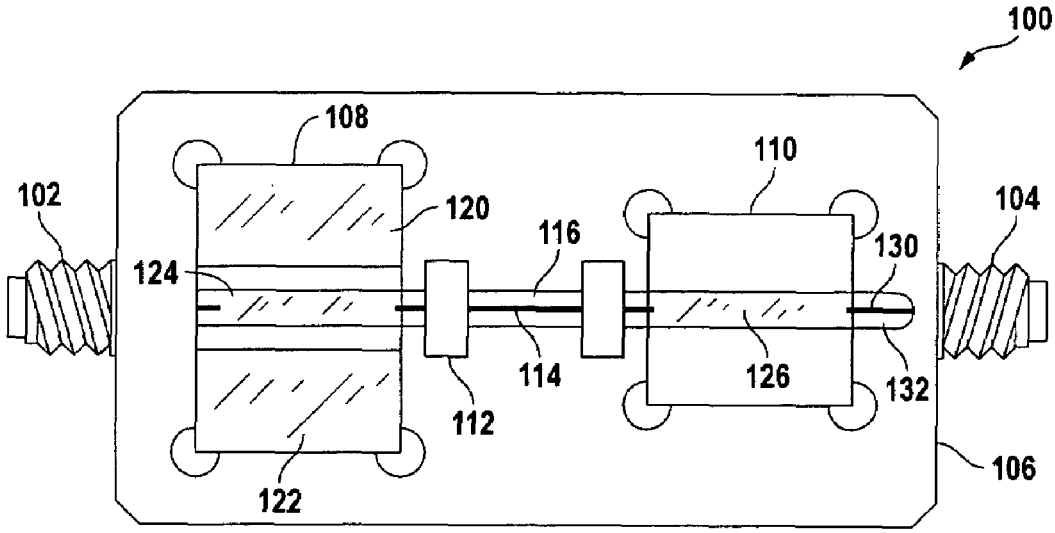
FIG. 1 shows a plan view of a high-frequency microcircuit according to an embodiment of the invention.

FIG. 1 shows a plan view of a high-frequency microcircuit 100 according to an embodiment of the invention. Package feed-throughs 102, 104 are attached to a microcircuit housing 106. The package feed-throughs attach to cables and couple high-frequency signals into and out of the high-frequency microcircuit. A first electronic component 108 is connected to a second electronic component 110 with an interconnection 112. The interconnection includes a center conductor 114 that forms a slab line transmission line in cooperation with a slot 116 in the microcircuit housing 106. The first electronic component is a co-planar circuit, and the second electronic component is a microstrip circuit, but alternatively are any electronic components used in high-frequency microcircuits. Those of skill in the art of high-frequency microcircuits appreciate that more complicated circuits are often used, thus the co-planar and microstrip circuits are merely exemplary, and are used for simplicity of illustration and discussion.

The co-planar circuit 108 has ground planes 120, 122 on either side of a center conductor 124. Co-planar circuits are often fabricated on sapphire, ceramic, or organic-based substrates. The microstrip circuit has a center conductor 126 on the topside of the substrate, which is also typically sapphire, ceramic, or organic-based. The cooperating ground plane is formed on the backside (not shown) of the substrate. The center conductor 124 of the co-planar circuit 108 is coupled to the center conductor 116 of the interconnection 112, as is the center conductor 126 of the microstrip circuit 110. In alternative embodiments, the center conductor 116 of the interconnection 112 is connected or coupled to a pad of a semiconductor integrated circuit ("IC"), transistor, diode, capacitor, or other electronic component.

One of the package feedthroughs 104 includes a center conductor 130 in a slot 132 in the microcircuit housing 106 according to an embodiment wherein the center conductor 130 cooperates with the slot 132 to form a slab line transmission line. The package feedthrough 104 includes a coaxial transmission structure that is configured to mate to a coaxial cable. The transition from a coaxial transmission structure to the slab line is desirable for suppressing unwanted modes of transmission. The slab line provides a transmission structure in which the magnetic and electric fields align transversely to the direction of propagation for the fundamental mode. The transverse electromagnetic modes ("TEMs") of the slab line portion maintain the characteristic impedance of the line (package feedthrough) with respect to frequency (i.e. little or no dispersion), as well as providing high isolation.

Figure 2A:
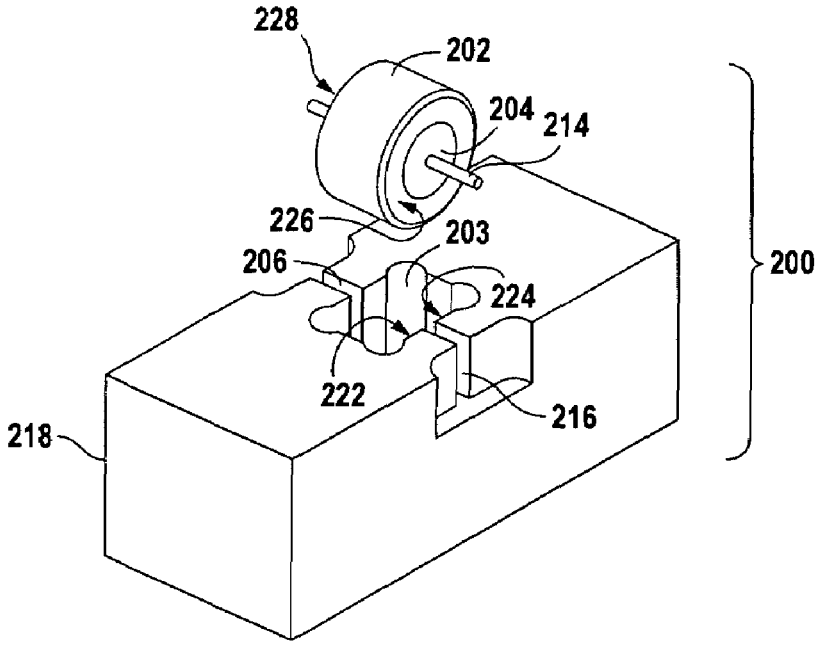
FIG. 2A shows a perspective partially exploded view of an interconnect according to an embodiment of the invention.

FIG. 2A shows a perspective partially exploded view of an interconnection 200 according to an embodiment of the invention. The interconnection 200 includes a center conductor 214 extending through a conductive bead ring 202. In a particular embodiment, the conductive bead ring has an inner diameter of about 1 mm, an outer diameter of about 2 mm, and is configured to be press-fit into a corresponding receiving feature 203 in the microcircuit housing 218. The corresponding slot 216 is also on the order of about 0.5 to about 1.0 mm wide, depending on the desired impedance, and in a particular embodiment was about 0.31 mm, and used with a center conductor having an outer diameter of about 0.157 mm. It is particularly desirable to provide slab line portions having a width less than 1.00 mm in order to suppress unwanted transmission modes up to about 100 GHz. A dielectric support 204, such as machined bead of cross-linked polystyrene (e.g. REXOLITE™, available from C-LEC PLASTICS, INC.), holds the center conductor 214 coaxially in the conductive bead ring 202. Alternatively, the dielectric support is a glass bead or other dielectric material. Thus, the portion of the center conductor 214 extending through the conductive bead ring 202 forms a coaxial waveguide structure. In a particular embodiment, the coaxial waveguide structure has a selected impedance equal to a characteristic impedance of at least one of the electronic components being interconnected.

The interconnection 200 also includes slots 206, 216 formed in a microcircuit housing 218, only a portion of which is shown. Other portions of the microcircuit housing hold electronic components electronically connected together with the interconnection (see FIG. 1, ref. nums. 108, 110). The microcircuit housing 218 is conductive, typically metal. The bead ring 202 is pressed, soldered, or otherwise fitted into the microcircuit housing 218 so that end faces 222, 224 of the slot 216 electrically couple to, and preferably contact, the transverse face 226 of the bead ring 202 to provide a contiguous, un-impeded ground current path from the slot 216 to the transverse face 226 of the bead ring 202, and then to the outer circumference of the bead ring. Similarly, the opposing transverse face 228 of the bead ring 202 couples to the corresponding faces of the second slot 206.

This results in a transmission structure that transitions from a first slab line portion (i.e. the slab line transmission structure formed from the portion of the center conductor 214 extending through the first slot 206), to a coaxial portion (i.e. the portion of the center conductor 214 extending through the bead ring 202), and then to a second slab line portion (i.e. the slab transmission structure formed from the portion of the center conductor 214 extending through the second slot 216). The transition from slab line to coaxial transmission portions suppresses undesired transmission modes, providing high isolation. Maintaining a characteristic impedance from a slab line portion to a coaxial portion provides very low loss in the intended transmission path.

The portion of the microcircuit housing 218 in which the bead ring 202 is received will be referred to as a "web" of the microcircuit housing for purposes of discussion. Comparing the package feedthrough 102 in FIG. 1, the center pin of the package feedthrough extends through a coaxial hole (not shown) drilled in the end edge of the package housing 106. Drilling coaxial holes in the edges of a housing is relatively easy, and forms a convenient coaxial transmission structure to the interior of the microcircuit housing, namely, to the center conductor 124 of the coplanar circuit 108. However, drilling holes in a web of the microcircuit housing is impractically difficult. Forming a slot in a web of a microcircuit housing is desirable from a manufacturing perspective, and provides a low loss, high isolation interconnection when used in cooperation with a center conductor from a bead ring structure. In particular, even if a coaxial hole could be drilled in a web, assembling the center conductor through the hole presents additional manufacturing challenges, and would not provide the mode suppression that a slab line-to-coaxial transition provides.

Figure 2B:
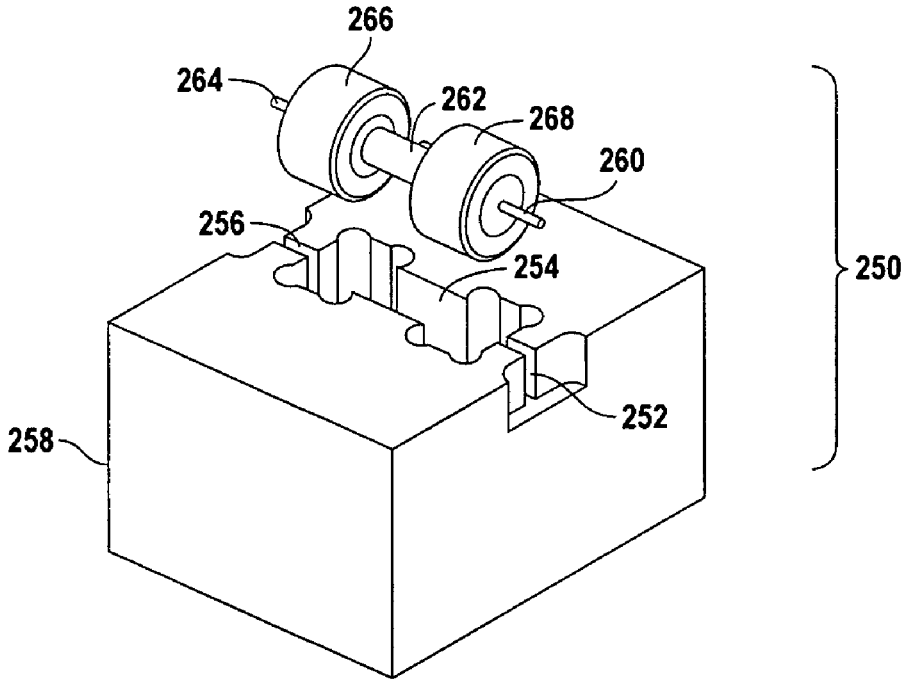
FIG. 2B shows a perspective partially exploded view an interconnect according to another embodiment.

FIG. 2B shows a perspective partially exploded view an interconnection 250 according to another embodiment. Slots 252, 254, 256 are formed in a microcircuit housing 258 (only a portion of which is shown) to cooperate with a first end center conductor portion 260, an intermediate center conductor portion 262, and a second end center conductor portion 264 so as to form slab line transmission structures. The center conductor extends between two bead rings 266, 268 that are press-fit, soldered, or otherwise assembled with the microcircuit housing, as described above in reference to FIG. 2A. The diameter of the intermediate center conductor portion 262 is greater than the first end center conductor portion 260. The greater diameter of the intermediate center conductor portion 262 is desirable to minimize transmission losses through the central slab line portion of the interconnection 250. The smaller diameter of the first end center conductor portion 260 is desirable for contacting to similarly sized pads or center conductor of an electrical component. This optional feature is discussed further in reference to FIG. 3. Embodiments according to FIG. 2B are desirable for interconnecting electrical components that are spaced further apart, compared to embodiments according to FIG. 2A, for example. Embodiments according to FIG. 2B are also desirable for further suppressing unwanted modes (i.e. improving isolation) because of the multiple slab line-to-coaxial transitions. Additional bead rings and slots are added to interconnections in alternative embodiments to provide additional slab line-to-coaxial transitions, providing additional isolation or additional interconnect length.

Figure 2C:
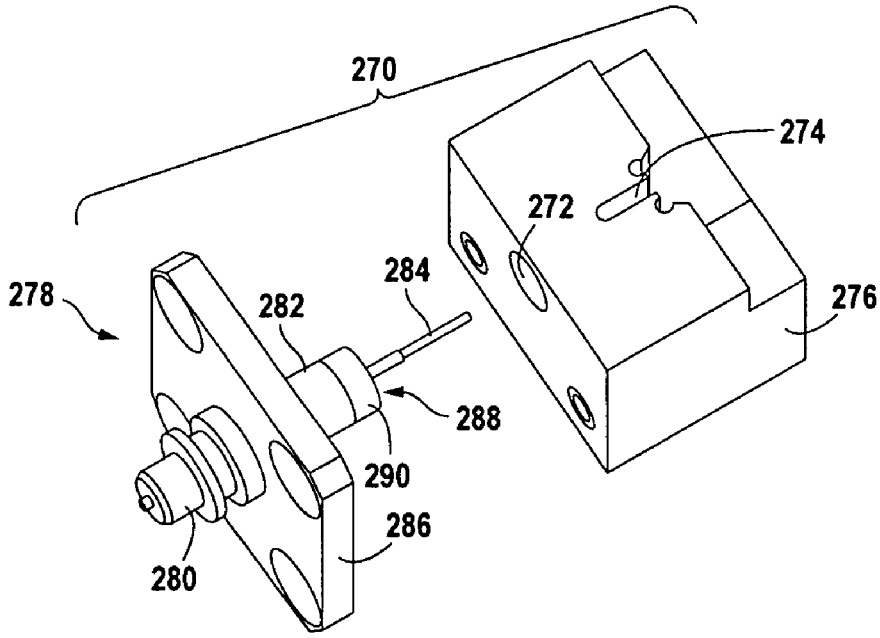
FIG. 2C shows a perspective partially exploded view of an interconnect according to yet another embodiment.

FIG. 2C shows a perspective partially exploded view of an interconnection 270 according to yet another embodiment. A hole 272 and a slot 274 are formed in a microcircuit housing 276 (only a portion of which is shown). The hole 272, which is a receiving feature for a bead ring 290, is formed in a side of the microcircuit housing 276. A package feedthrough 278 includes a coaxial connector interface portion 280, a coaxial feedthrough portion 282 that is inserted into the hole 272 and a center conductor portion 284 that cooperates with the slot 274 to form a slab line transmission structure proximate to an electrical component (not shown, see FIG. 1, ref. num. 110). The coaxial connecter interface portion 280 is a 1.85 mm connector, SMA-type connector, SMC-type connector, APC-7-type connector, or other type of coaxial connecter interface, many of which are familiar to those of skill in the art of high-frequency components, and are generally configured to connect to a mating connector interface.

A bulkhead 286 is attached to the microcircuit housing 276 with screws (not shown), which presses the transverse face 288 of the bead ring 290 against end faces of the slot 274, as described above in reference to FIG. 2A to provide an un-impeded path for ground currents from the walls of the slot to the face of the bead ring.

Figure 3:
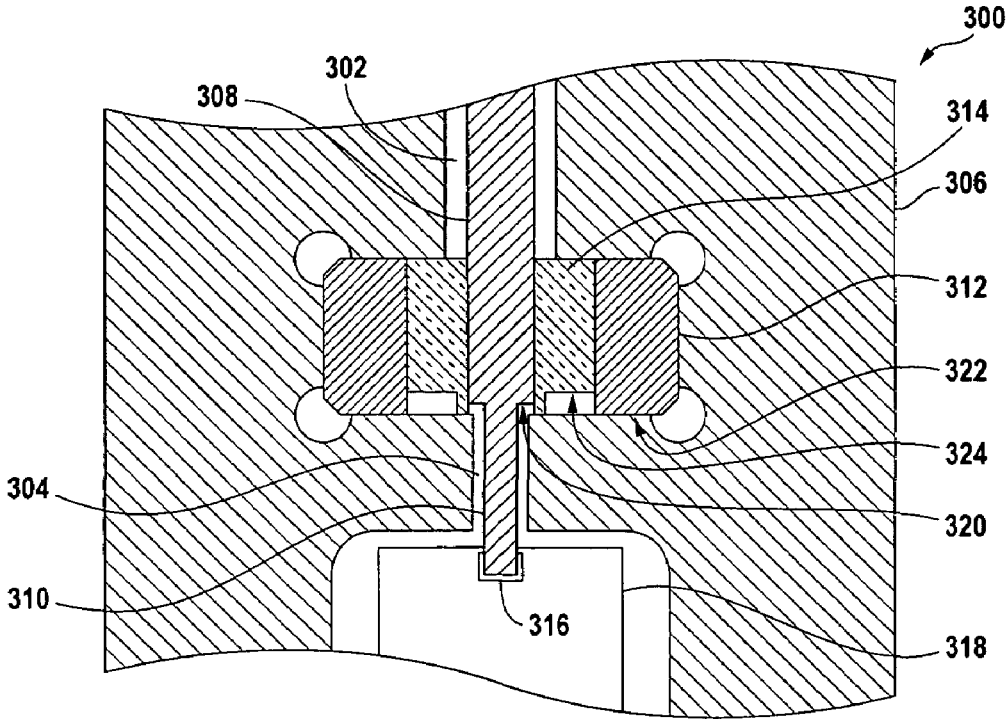
FIG. 3 is a cross section of a portion of an interconnection according to an embodiment.

FIG. 3 is a cross section of a portion of an interconnection 300 according to an embodiment. Slots 302, 304 have been formed in a microcircuit housing 306. A first center conductor portion 308 cooperates with the first slot 302 to form a first slab line transmission structure. A second center conductor portion 310 cooperates with the second slot 304 to form a second slab line transmission structure. The first center conductor portion has a greater diameter than the second center conductor portion, and extends substantially through a bead ring 312. A dielectric support 314 supports the center conductor in the bead ring 312 in a coaxial fashion. The diameter of the second center conductor portion 310 has been reduced to localize the electromagnetic fields at a pad 316 of an electronic component 318, such as an IC. This improves performance considerations, as the electromagnetic fields are gradually concentrated to the pads of the electronic component. In a particular embodiment, contact will be made to a 0.004 inch pad, and the diameter of the center conductor is stepped down to provide a practical contact to a pad of this size.

The step-down in the diameter of the center conductor forms an impedance discontinuity, which is compensated for by moving the plane of the step 320 back from the transverse face 322 of the bead ring 312. The transverse face 324 of the dielectric support 314 is optionally also set back from the transverse face 322 of the bead ring 312. A step-back in the face of the dielectric support can improve return loss, as discussed below in reference to FIG. 4.

The bead ring 312 is press-fit into a corresponding receiver feature in the microcircuit housing 306. Press-fitting bead ring assemblies (i.e. the bead ring, dielectric support, and center conductor) into the receiver feature(s) of the microcircuit housing provide a practical manufacturing technique that maintains ground continuity at the bead ring-housing interface. Solder, conductive epoxy, or other techniques are alternatively used. The circumference of a cylindrical bead ring also properly locates the center conductor in the corresponding slot(s) so as to form low loss, high isolation slab line transmission structures.

Figure 4:
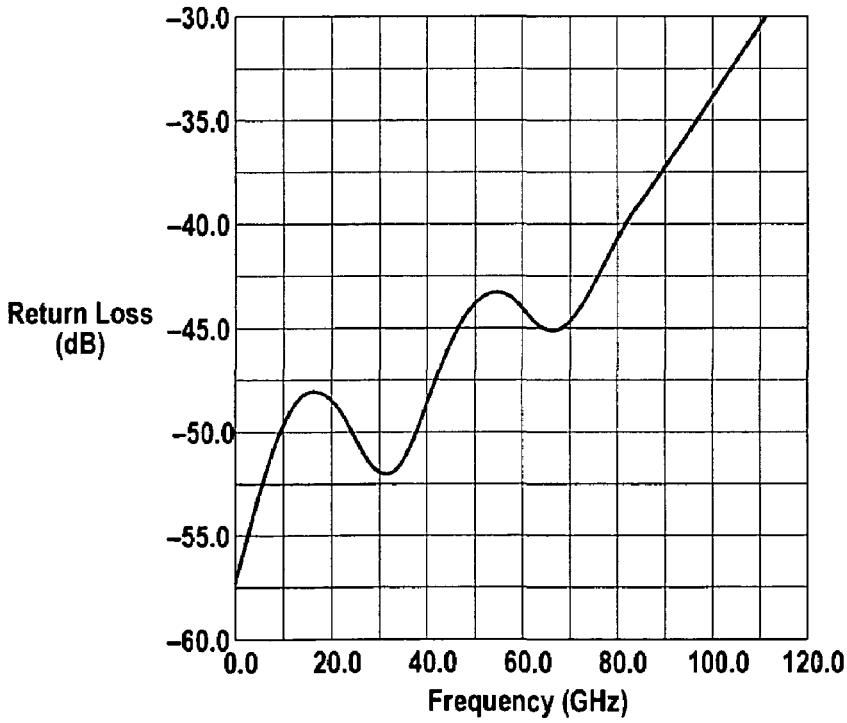
FIG. 4 is a plot showing the modeled return loss versus frequency for an interconnection according to an embodiment.

FIG. 4 is a plot showing the modeled return loss versus frequency for an interconnection according to an embodiment. The results were obtained using a high-frequency structure simulator (HFSS™), available from ANSOFT CORPORATION of Pittsburgh, Pa. A slab line-to-ring bead-to-slab line was modeled, and the step-back of the dielectric bead (see FIG. 3, ref. num. 324) was varied to provide better than minus 30 dB of insertion loss at 110 GHz.

An exemplary interconnection substantially in accordance with FIG. 2B was fabricated in a test package using bead rings having a 1 mm inner diameter, REXOLITE dielectric supports, and a slot about 0.81 mm wide by about 2.58 mm deep and about 31 mm long. The center conductor through the slot portion of the interconnection was about 0.432 mm outer diameter, providing an interconnection for use in a fifty-ohm system. The test package used 1 mm package feedthroughs, and 1 mm-to-1.85 mm adaptors were used to connect the test package to a vector network analyzer ("VNA")-based measurement system. After accounting for the insertion loss through the adaptors, the insertion loss of the interconnection was about 0.08 dB/cm at 20 GHz.

A similar test package was fabricated using a microstrip thin-film transmission line fabricated on a sapphire substrate about 0.635 mm thick. The insertion loss for the sapphire microstrip transmission line was about 0.091 dB/cm at 20 GHz, which is a combination of the dielectric loss in the sapphire and the loss in the conductor. Thus, the interconnection provided a lower loss connection than a comparable thin-film microstrip transmission line at 20 GHz.

However, loss through a thin film microstrip transmission line generally increases with decreasing geometry (i.e. center conductor width and thinner substrate). A sapphire substrate 0.635 mm thick is undesirably thick for operation at frequencies in the 50-110 GHz region. Similarly, the width of the center conductor, and hence its cross section, is decreased to cooperate with the thinner substrate, which increases the resistance-per-length of the center conductor. Therefore, a thin-film microstrip transmission line designed for operation at 67 GHz, for example, would have much more loss than the 0.091 dB/cm than the example above at 20 GHz.

While the preferred embodiments of the present invention have been illustrated in detail, it should be apparent that modifications and adaptations to these embodiments might occur to one skilled in the art without departing from the scope of the present invention as set forth in the following claims. For example, the center conductor has generally been described in terms of a round cross section, but center conductors or corresponding bead rings and slots, alternatively have square, rectangular, triangular, oval, or other-shaped cross sections.

What is claimed is:

1. An interconnection comprising:
a microcircuit package having
a slot, and
a receiving feature;
a bead ring fitted into the receiving feature;
a dielectric support disposed in the bead ring; and
a center conductor extending through the bead ring and through the slot so as to form-a coaxial transmission structure in cooperation with the bead ring and the dielectric support and to form a slab line transmission structure in cooperation with the slot.

2. The interconnection of claim 1 wherein the bead ring is press-fit into the receiving feature.

3. The interconnection of claim 1 wherein the bead ring is soldered to the receiving feature.

4. The interconnection of claim 1 wherein the slot has end faces electrically coupled to a transverse face of the bead ring so as to provide an un-impeded ground current path.

5. The interconnection of claim 1 wherein the center conductor has a first center conductor portion having a first diameter and a second center conductor portion having a second diameter less than the first diameter, the second center conductor portion being an end center conductor portion.

6. The interconnection of claim 5 wherein the end center conductor portion is electronically coupled to a pad of an electronic component disposed in the microcircuit housing.

7. The interconnection claim 1 further comprising
a coaxial connector interface portion; and
a coaxial feedthrough portion disposed between the coaxial connector interface portion and the bead ring, wherein the bead ring is press-fit into the receiving feature.

8. An interconnection comprising:
a microcircuit package having
a slot, and
a receiving feature;
a bead ring fitted into the receiving feature;
a dielectric support disposed in the bead ring; and
a center conductor extending through the bead ring and through the slot so as to form a coaxial transmission structure in cooperation with the bead ring and the dielectric support and to form a slab line transmission structure in cooperation with the slot wherein the center conductor has a first center conductor portion having a first diameter and a second center conductor portion having a second diameter less than the first diameter, the second center conductor portion being an end center conductor portion wherein a step at a transition between the first center conductor portion and the second center conductor portion is set back from a transverse face of the bead ring.

9. The interconnection of claim 8 wherein a transverse face of the dielectric support is set back from the transverse face of the bead ring.

10. An interconnection comprising:

a microcircuit package having a slot, and a receiving feature;

a bead ring fitted into the receiving feature;

a dielectric support disposed in the bead ring; and a center conductor extending through the bead ring and through the slot so as to form a coaxial transmission structure in cooperation with the bead ring and the dielectric support and to form a slab line transmission structure in cooperation with the slot further comprising:

a second slot formed in the microcircuit housing, a second receiving feature formed in the microcircuit housing, and a third slot formed in the microcircuit housing;

a second bead ring fitted into the second receiving feature;

a second dielectric support disposed in the second bead ring, wherein the center conductor extends through the second slot, the second bead ring, and the third slot.

11. An interconnection comprising:

a microcircuit package having a slot, and a receiving feature;

a bead ring fitted into the receiving feature;

a dielectric support disposed in the bead ring; and a center conductor extending through the bead ring and through the slot so as to form a coaxial transmission structure in cooperation with the bead ring and the dielectric support and to form a slab line transmission structure in cooperation with the slot wherein the receiving feature is formed in a web of the microcircuit package between a first electrical component and a second electrical component.

* * * * *